US008371098B2

(12) United States Patent
Burchert et al.

(10) Patent No.: US 8,371,098 B2
(45) Date of Patent: Feb. 12, 2013

(54) FIBRE CHANNEL INSERT

(75) Inventors: Mathias Burchert, Ostfildern (DE); Siegfried Krohmer, Beuren (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 13/299,643

(22) Filed: Nov. 18, 2011

(65) Prior Publication Data

US 2012/0159920 A1 Jun. 28, 2012

(30) Foreign Application Priority Data

Nov. 19, 2010 (DE) ..... 10 2010 044 181

(51) Int. Cl.
*D01H 4/08* (2006.01)

(52) U.S. Cl. ..... 57/413

(58) Field of Classification Search ..... 57/404, 57/407, 408, 412, 413, 416
See application file for complete search history.

(56) References Cited

U.S. PATENT DOCUMENTS 5,111,651 A 5/1992 Pohn et al.
5,423,172 A * 6/1995 Furtmeier et al. ..... 57/407
5,555,717 A 9/1996 Schuller et al.
5,953,897 A 9/1999 Wassenhoven et al.
6,016,650 A * 1/2000 Legrom ..... 57/413
2007/0277497 A1 * 12/2007 Haaken et al. ..... 57/401
2012/0204530 A1 * 8/2012 Winzen ..... 57/413

OTHER PUBLICATIONS

German Patent Office Search Report, Apr. 13, 2011.

* cited by examiner

*Primary Examiner* — Shaun R Hurley
(74) *Attorney, Agent, or Firm* — Dority & Manning, P.A.

(57) ABSTRACT

A fiber channel insert is applicable in a mounting hole of an opening roller housing of an open-end spinning arrangement, whereby the fiber channel insert comprises a fiber channel body and a section of the fiber channel. The fiber channel body extends with its major axis essentially transversely to a major axis of the fiber channel. An open-end spinning arrangement with a spinning element and an opening roller housing, in which an opening roller is arranged in a rotatable way includes a fiber channel that transports the fiber material to be spun from the opening roller to the spinning element. A section of the fiber channel is provided in a fiber channel insert that is insertable in a mounting opening of the opening roller housing, the fiber channel insert having a primarily cylindrical fiber channel body. The fiber channel body extends with its major axis essentially transversely to a major axis of the fiber channel, and the fiber channel insert is primarily insertable axially parallel to the opening roller axis.

13 Claims, 4 Drawing Sheets

FIBRE CHANNEL INSERT

FIELD OF THE INVENTION

The present invention relates to a fibre channel insert that is applicable in a mounting hole of an opening roller housing of an open-end spinning arrangement. The fibre channel insert includes a fibre channel body and contains a section of the fibre channel. Furthermore, the present invention relates to an open-end spinning arrangement having a spinning element and an opening roller housing, in which an opening roller is arranged in a rotatable way. The open-end spinning arrangement further includes a fibre channel, which fibre channel transports the fibre material to be spun from the opening roller to the spinning element, whereby a section of the fibre channel is provided in a fibre channel insert which is insertable in a mounting opening of the opening roller housing.

BACKGROUND

In open-end spinning arrangements, great importance is attached to the design of the fibre channels, in particular the entry area of the fibres channels, in relation to the quality of the spun yarn, as well as to the spinning stability. By means of the application of various fibre channel designs in relation to the form of the cross sections and the surface structure, as well as to the technologically critical importance of the design of the entry area of the fibre channels, it is possible to make adaptations to a variety of materials to be spun, for example to coarse yarns, fine yarns or synthetics.

German published patent application DE 44 16 977 A1 discloses an open-end spinning arrangement in which the fibre feed channel consists of two channel sections, whereby the first channel section consists of an insert piece arranged in a recess of the opening roller housing. The insert piece is arranged in an exchangeable way by means of a flexible retaining element. By these means, this section of the fibre channel can, in the case of wear, be replaced in a simple way by a new section, in that the adapter is replaced. Furthermore, this capacity for exchange permits adaptation to a variety of fibre materials. In order to replace an adapter, the opening roller housing first has to be swung away from the rotor housing. The adapter can subsequently be removed in a direction perpendicular to the opening roller axis.

German published patent DE 197 12 881 B4 also discloses a fibre feed channel, which is applicable as an exchangeable insert piece in an opening roller housing. This fibre channel is designed as a cast part, whereby an integrally cast moulded position-fixing device is provided, which ensures that a defined mounting position in the opening roller is maintained. The fibre channel insert hereby comprises the actual fibre channel and the fibre detaching edge, while the fibre detaching area is located in the opening roller housing.

SUMMARY

It is an object of the present invention to create a fibre channel insert piece, which on the one hand permits a simple adaptation to a variety of applications, and on the other hand permits a favourable graduation from the opening roller housing into the fibre channel. Furthermore, it is also an object of the present invention to create a correlating open-end spinning arrangement. Additional objects and advantages of the invention will be set forth in part in the following description, or may be obvious from the description, or may be learned through practice of the invention.

In a further embodiment, a fibre channel insert, which can be applied in a mounting opening of an opening roller housing of an open-end spinning arrangement, comprises a fibre channel body. The fibre channel insert comprises a section of a fibre channel. According this embodiment, the major axis of the fibre channel body is aligned primarily transversely to the major axis of the fibre channel.

In a further embodiment, an open-end spinning arrangement comprises a spinning element and an opening roller housing with an opening roller arranged in a freely rotatable way. The opening roller housing is connected to the spinning element by means of a fibre channel for transporting the fibre material to be spun. The opening roller housing comprises a mounting opening, in which a fibre channel insert comprising a fibre channel body is insertable. The fibre channel body including a section of the fibre channel. In the case of the open-end spinning arrangement, the major axis of the fibre channel body extends primarily transversely to a major axis of the fibre channel, whereby the fibre channel insert is insertable primarily axially parallel to the axis of the opening roller. The mounting opening in the opening roller housing extends therefore axially parallel to the opening roller.

In contrast to the fibre channel inserts of prior art, whose main extensions and major axes are oriented in the direction of the fibre channel and are accordingly insertable perpendicular in a direction relative to the opening roller axis in the opening roller housing, the present invention suggests a fibre channel insert having a major axis arranged transversely offset, advantageously at an angle of 90°, to the direction of the fibre channel. The major axis of the fibre channel insert corresponds to the rotational axis and in the case of another geometry, the major axis corresponds to the direction of the longest dimension.

The staggered arrangement provides options for devising the first part of the fibre channel, and in particular the crossover from the opening roller housing into the fibre channel, in a manner which can comply with individual fibre requirements, for example, because the fibre channel insert can extend along a large section, or the entire width of the opening roller housing. Furthermore, in relation to the crossover area to the fibre channel in the circumferential direction of the opening roller, the transverse orientation of the fibre channel insert in relation to the fibre channel major axis also provides improved design options for the entry area into the fibre channel. Furthermore, the exchangeability of the fibre channel insert is facilitated, as the fibre channel insert can be assembled and disassembled axially parallel to the opening roller axis and accordingly, the opening roller housing does not need to be swivelled away from the rotor housing. Access to the fibre channel insert is therefore improved.

Furthermore, with the adapter according to an embodiment of the present invention, it is possible to optimise individual sections of the fibre channel in accordance with the desired application. The fibre channel insert can comprise, as a section for example only the fibre detaching area or the fibre detaching edge or also both of these areas which form the entry area. Furthermore, the fibre channel insert can also comprise the first section of the actual fibre channel. If the further transport area of the fibre channel is also provided in a replaceable insert, this increases flexibility and permits the adjustment to individual applications particularly well.

According to an advantageous embodiment of the invention, the fibre channel insert comprises a supporting surface which is orientated primarily parallel to the major axis of the fibre channel and which determines the position of the fibre channel in relation to the axial direction of the opening roller. In an open-end spinning arrangement, the mounting opening comprises a supporting surface which is orientated primarily parallel to the major axis of the fibre channel, whereby said supporting surface interacts with supporting surface of the fibre channel insert so that the fibre channel can be positioned in relation to the axial direction of the opening roller. By doing so, the correct position of the fibre channel in relation to the width of the opening roller can be ensured. It is further advantageous when the supporting surface comprises at least one positioning device and/or a centering device. By means of the positioning device, the fibre channel insert can be positioned in relation to its angle with the opening roller and, on the other hand, it can be ensured that no disadvantageous transitional steps from the opening roller housing to the fibre channel insert arise due to a twisted position of the fibre channel insert. A centering device could also prevent such disadvantageous transitional steps. Instead of a centering device on the supporting surface, a centering over the casing surface of the fibre channel body is possible in that, for example, a centering diameter is provided. The positioning of the fibre channel insert can also take place by means of positioning elements arranged on the casing surface, which positioning elements interact with corresponding devices of the mounting opening. Due to the formation of the positioning devices, as well as the centering devices on the supporting surface, which forms a front surface of the cylindrical fibre channel body, a particularly compact embodiment is achieved which is in addition simple to manufacture.

It is particularly advantageous in relation to the manufacture of the fibre channel insert and the mounting opening, and also in relation to the assembly, when the fibre channel insert comprises a primarily cylindrical or conical fibre channel body.

It is further advantageous when the fibre channel body comprises a primarily circular cylindrical area, in particular a base area with a groove for a sealing element. The fibre channel can hereby be sealed from the opening roller housing in a reliable way. Depending on the design of the circular cylindrical area, it can at the same time serve as an aid to assembly and removal of the fibre channel insert.

According to an advantageous design of the present invention, the fibre channel insert comprises only the fibre releasing area. This prevents disadvantageous transitional steps from the opening roller housing to the fibre channel, which could prevent a straight orientation of the fibres, or cause fibre accumulations. Particularly advantageous is when the fibre channel insert continues to form a part of the circumferential wall of the opening roller in fibre flow direction upstream of the fibre releasing area. The entry area into the fibre channel can be optimised hereby in relation to the fibre flow, and the crossover area can be re-located to a non-critical area beyond the entry area.

According to a further advantageous embodiment of the present invention, the fibre channel insert continues to comprise the fibre detaching edge. The fibre detaching edge is subject to a high level of wear and can be designed in the insert in a wear-resistant way. It is also advantageous when the fibre channel insert comprises the first section of the fibre channel so that in this area also an adaptation to various conditions, for example, differing fibre channel cross sections, is possible.

It is hereby particularly advantageous when the fibre channel insert can be applied in an easily exchangeable way in the mounting opening of the opening roller housing. An adaptation to various spinning materials as well as an exchange in the case of wear is also facilitated.

In accordance with an advantageous embodiment of the present invention, the fibre channel insert comprises two effective areas, each of which comprises at least one fibre detaching area. Two different sections of a fibre channel can hereby be arranged in one single adapter, achieving an adaptation to the spinning materials without an exchange of the fibre channel insert, simply by means of a staggered or turned out of position assembly of the same fibre channel insert. Particularly advantageous in this case is when both effective areas are arranged radially staggered in the fibre channel body. The fibre channel insert is hereby applicable in two radially offset positions in the mounting opening. However, it is also an option to arrange to the two effective areas axially offset one behind the other, whereby the fibre channel insert is applicable turned by 180° in the mounting opening of the opening roller housing.

A further advantageous embodiment of the present invention provides that the fibre channel insert comprises a grip area, by means of which the fibre channel insert can be applied to the mounting opening and/or can be removed from same. Assembly and disassembly of the fibre channel insert is further facilitated hereby.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION

Figure 1:
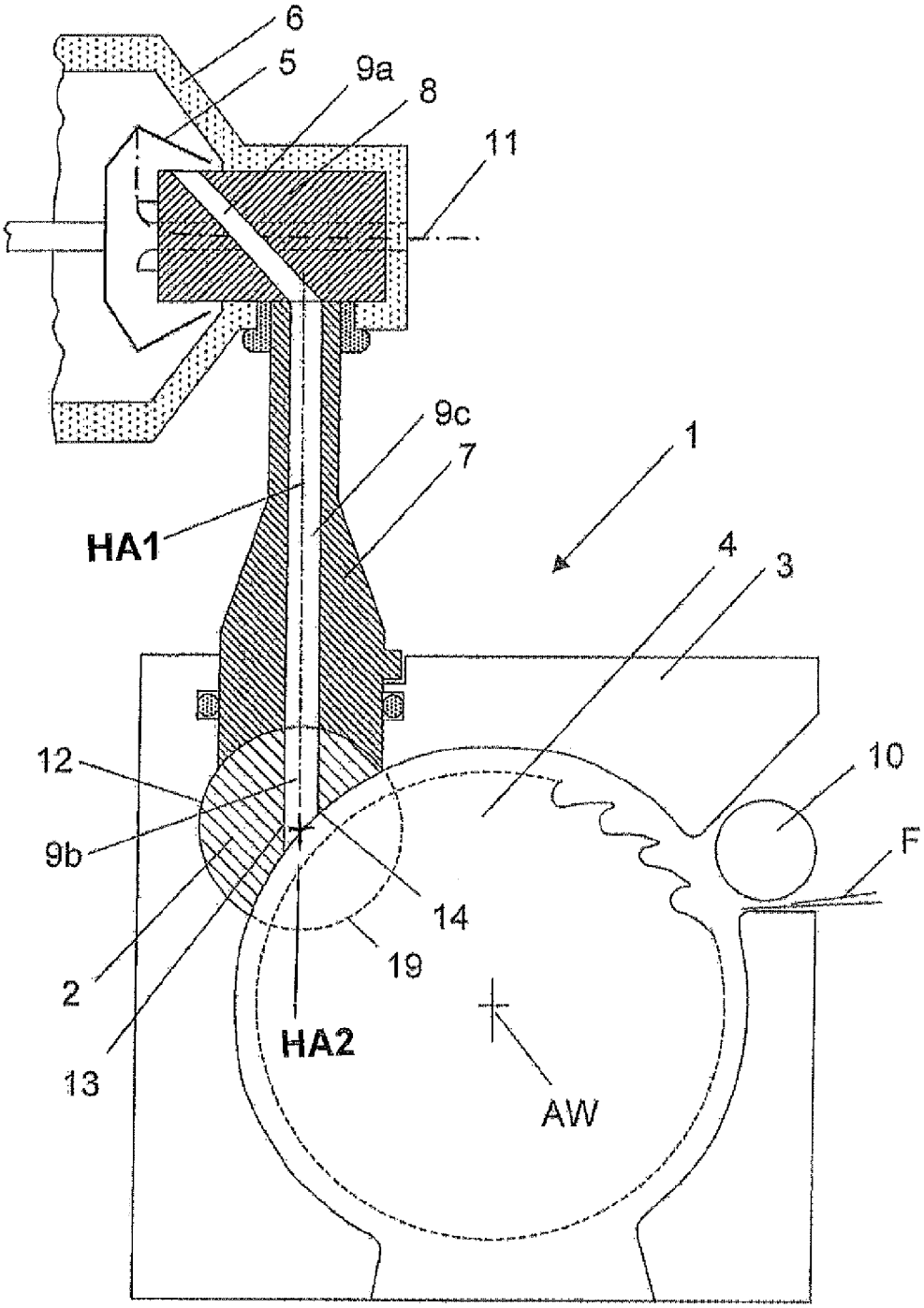
FIG. 1 shows an open-end spinning arrangement with a fibre channel insert in a schematic view.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows an open-end spinning machine 1 comprising a fibre channel insert 2 according to an embodiment of the present invention in a schematic sectional view. The open-end spinning arrangement 1 comprises an opening roller housing 3 comprising an opening roller 4 arranged in a rotatable way and also comprising a spinning rotor 5 as a spinning element, the rotor being arranged in a rotor housing 6 in which low pressure prevails. The open-end spinning arrangement 1 further comprises a fibre channel 9, which transports the fibre material F from the opening roller 4 to the spinning element 5. The fibre channel 9 contains a transport area 9*c*, which is arranged in the known way in a fibre channel component 7, which is mountable in the opening roller housing 3.

According to the view at hand, a feed area 9*a* of the fibre channel 9 is provided in an exchangeable channel plate adapter 8 mountable in the rotor housing 6, which permits a simple adaptation to various spinning conditions or different rotor diameters. The feed area 9*a* can however also be arranged in a fixed manner in the rotor housing 6 or the transport area 9 of the fibre channel can also be arranged in a fixed manner in the opening roller housing.

A fibre material F is fed to the opening roller 4 in the known way via a feeding device 10. By means of the rotation of the opening roller 4, which is denoted by an arrow, the fibres are combed out of the fibre material F to single fibres and fed to the fibre channel 9. By means of the prevailing low pressure in the rotor housing 6, an air stream is generated in the fibre channel 9, which effects subsequently the transport of the combed out fibres through the fibre channel 9 to the spinning element 5, in which spinning element 5 the single fibres are spun in the known way to a yarn 11 and withdrawn.

A fibre channel insert 2 is provided in accordance with aspects of the present invention, the fibre channel insert 2 being mountable in a mounting opening 12 of the opening roller housing 3, and comprising at least one section 9*b*, 13, 14 of the fibre channel 9. In contrast to known embodiments in the prior art, the major axis HA2 of the fibre channel body extends primarily transversely to one major axis HA1 of the fibre channel 9 and thus primarily axially parallel to an axis AW of the opening roller 4. The drawing shows the major axis HA2 of the fibre channel body extending 90° staggered to the fibre channel major axis HA1, but the fibre channel body can, however, also meet the fibre channel major axis HA1 at a slight angle.

The drawing shows that the fibre channel insert 2 comprises the fibre opening area 13, which guides the opened fibres into the transport area 9*c* of the fibre channel 9, and also comprises the fibre detaching edge 14, by means of which the fibres are released from the opening roller 4. In this embodiment, the fibre channel insert 2 also contains the first section 9*b* of the fibre channel 9. The fibre channel insert 2 is advantageously arranged in the mounting opening 12 of the opening roller housing 3 in such a way that it is simple to replace, that is, without the use of tools, so that adaptation to various spinning conditions and fibre materials can take place easily. It is also possible to replace the fibre channel insert 2 in a simple way in the case of wear, in particular in the case of very worn fibre opening edges 14. It is therefore possible to attain an optimal yarn quality without impairing the spinning stability.

Figure 2:
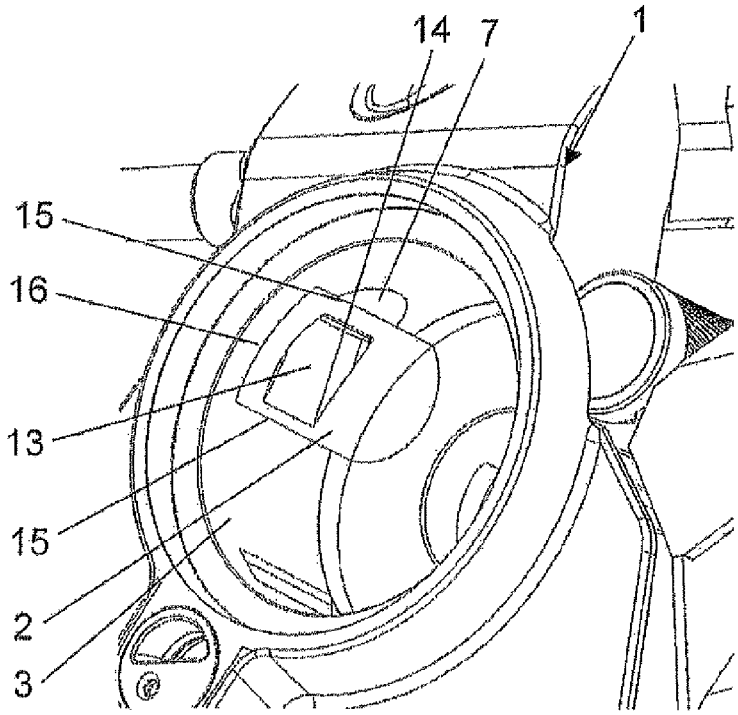
FIG. 2 shows a perspective of a fibre channel insert according to the present invention.

By means of the orientation of the fibre channel insert 2 in accordance with the present invention transversely to the fibre channel major axis HA1, a particularly advantageous fibre flow can be achieved and the risk of fibres adhering to crossover points 15, 16, or forming hooks at one end, is reduced considerably. As can be seen in FIG. 2, the fibre channel insert 2 extends along almost the entire width of the opening roller 4 and the corresponding area of the opening roller housing 3, so that, in contrast to known fibre channel inserts 2 of prior art, crossover gaps 15 are formed, which extend transversely to the direction of the fibre flow. As the crossover gaps 15 are located hereby outside of the fibre entry area and the fibre releasing area 13, the risk of adherence of, as well as damage to the fibres, is greatly reduced. A further crossover gap 16 forms longitudinally to the direction of fibre flow between the fibre channel insert 2 and the opening roller housing 3. Because the fibre channel insert 2 extends, in contrast to adapters of prior art, along almost the entire width of the inner wall of the opening roller housing 3, the crossover 16 lies outside of the fibre flow area. The second crossover gap 15 in relation to the fibre flow direction also is located between the opening roller housing 3 and the fibre channel insert 2 outside of the fibre flow area. The first crossover gap 15 can, depending on the type of design, continue to be placed with a fibre channel insert set staggered to a fibre channel major axis HA1, in an area a good way upstream of the fibre releasing area in which the risk of damage to, and adherence of the fibres, is reduced. By applying the fibre channel insert 2 according to the present invention, the fibres can be transported in a particularly damage-free and risk-free way, whereby by means of various embodiments of the fibre channel insert 2 in relation to the cross sections of the starting area 9*b* of the fibre channel 8, and by means of the surface structure, an optimal adaptation can always be reached and the detaching characteristics influenced.

The diagram shows the fibre channel insert 2 in this case being somewhat laterally staggered in relation to the fibre channel component 7, so that a comparably long fibre releasing area 13 arises and very advantageous conditions are created in the fibre entry area and also a particularly advantageous location of the first crossover gap 15 in the direction of the fibre flow is achieved. Depending on the embodiment, size and arrangement of the fibre channel insert 2, which can, as shown in FIG. 1, also be arranged coaxially in direct extension of the fibre channel major axis HA1. By means of the fibre channel insert 2 of the present invention, it is furthermore possible to design the first section 9*b* of the fibre channel 9 differently from the rest of the fibre channel 9 and from the transport area 9*c*, for example with a widened or narrowed cross section.

Figure 3:
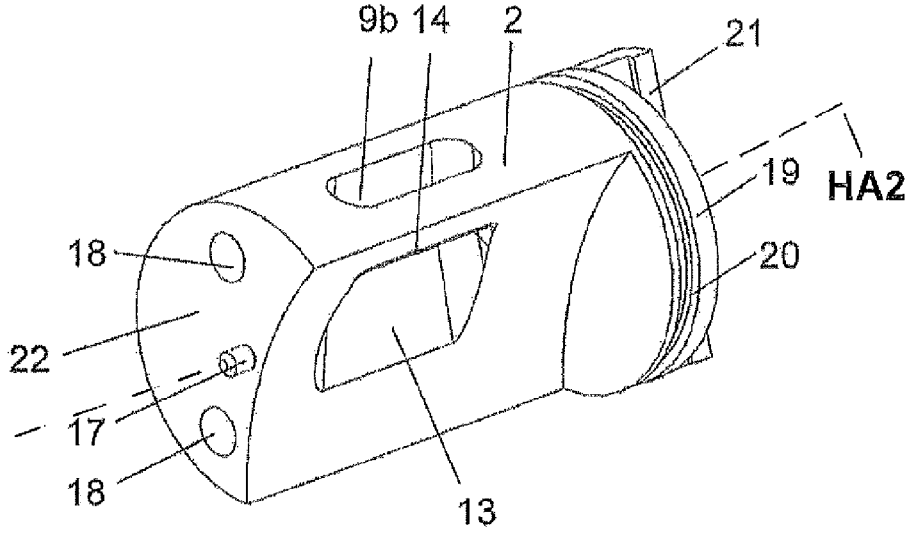
FIG. 3 shows an inner view of the opening roller housing, in which a fibre channel insert according to the present invention is inserted.
Figure 4:
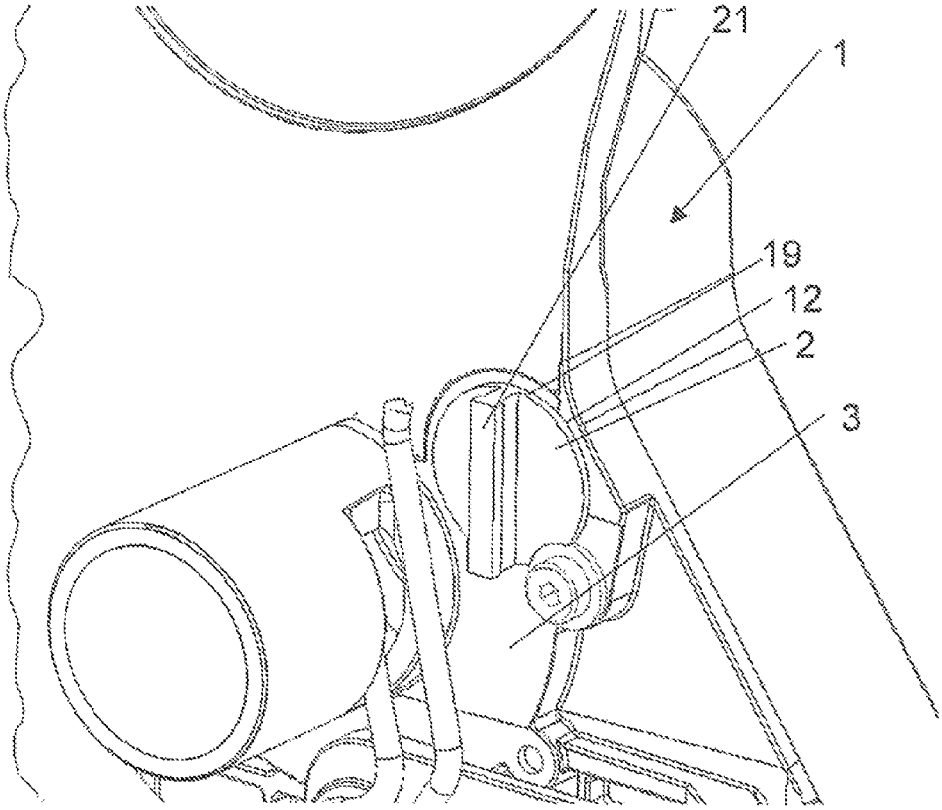
FIG. 4 a back view of an open-end spinning arrangement according to the present invention comprising a fibre channel insert.

FIG. 4 shows a rear view of the opening roller housing 3, in which the fibre channel insert 2 is applied in a mounting opening 12 of the opening roller housing 3. The fibre channel insert 2 is assembled and disassembled hereby primarily axially parallel to the opening roller axis AW (opening roller 4 not shown), whereby by means of corresponding centering and positioning devices (see FIG. 3), the fibre channel insert 2 is automatically correctly positioned in relation to the fibre channel component 7. Assembly and disassembly of the fibre channel insert 2 of the present invention is hereby particularly simple, as access is gained to the fibre channel insert 2 already when the entire swivel housing is swung down without opening the opening roller housing 3. Assembly and disassembly of the fibre channel insert 2 can hereby take place independently of the fibre channel component 7 and the channel plate adapter 8, so that the arrangement of the components in relation to one another, as well as the diameter of the fibre channel, are not influenced by these elements.

FIG. 3 shows a perspective view of an embodiment of a fibre channel insert 2 of the present invention. The fibre channel insert 2 comprises a primarily cylindrical fibre channel body, in which the first section 9*b* of the fibre channel 9 is mounted perpendicular to the major axis HA2 of the cylindrical body. The first section of the fibre channel 9*b* and of the fibre channel 9 can also however be arranged at an angle to the major axis HA2. The fibre channel insert 2 comprises further the fibre releasing area 13, as well as the technologically significant fibre releasing edge 14. Due to the length of the cylindrical body, which extends along almost the entire width of the inner wall of the opening roller housing 3, multiple variation options in relation to extension, arrangement and geometry of the fibre entry area as well as the first section 9*b* are possible. Various cross section forms, reductions or expansions in these areas can be shown without any difficulties. Particularly advantageous in the case of the shown embodiment is that the fibre channel insert 2 comprises the complete fibre releasing area 13, so that the fibre releasing area 13 does not contain any disadvantageous crossovers for the fibre flow.

In order to achieve the correct positioning of the fibre channel insert 2 in the opening roller housing 3, the fibre channel insert 2 comprises a centering device 17 as well as two positioning devices 18. Centering can also however take place via the outer diameter of the body of the fibre channel insert 2. Positioning can also take place by means of a projection mounted on the casing surface of the fibre channel body, which projection interacts with a corresponding groove on the opening roller housing 3 in the area of the mounting opening 12. The centering and position axes are hereby also transverse according to the primary extension of the fibre channel insert 2, here arranged in this case offset at an angle of 90° in relation to the fibre channel main axis HA1. The present centering device 17 and the positioning device 18 are designed on a supporting surface 22, which extends primarily parallel to the main axis HA1 of the fibre channel 9. The supporting surface 22 interacts hereby with a supporting surface (not shown) of the opening roller housing 3 and in doing so determines the position of the fibre channel insert 2 in axial direction of the opening roller.

In the shown example embodiment, the fibre channel insert 2 still comprises a plain cylindrical area 19, which comprises a groove 20 for a sealing element (not shown here). The opening roller housing 3 can be sealed by means of sealing elements in order to prevent in-leaked air flowing in. Furthermore a hand grip area 21 is provided on the plain cylindrical area or in the present embodiment at the rear end of the fibre channel insert 2, by means of which hand grip area 21, the fibre channel insert 2 can be removed simply from the mounting opening 12. Just the circular cylindrical area 19 on its own can also be used as a hand grip.

Figure 5:
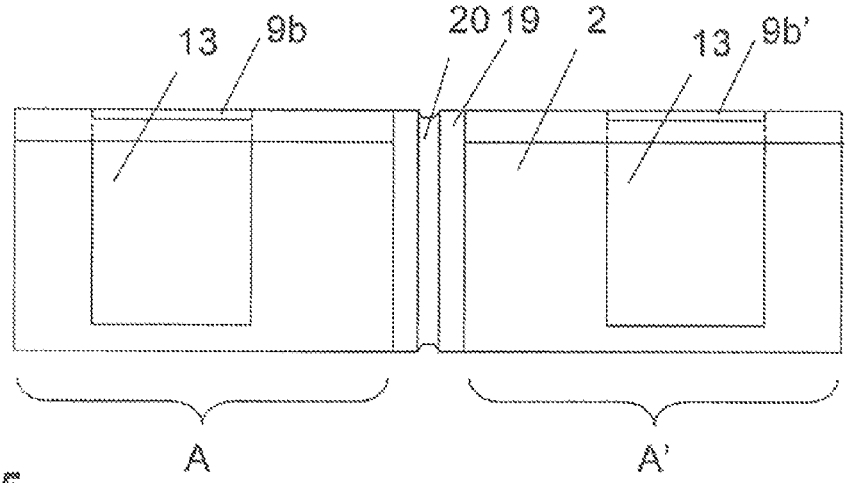
FIG. 5 shows a schematic view of a fibre channel insert comprising two effective areas arranged axially staggered to one another.

FIG. 5 shows a further embodiment of the present invention, in which the fibre channel insert 2 comprises a second effective area A', which contains at least a second fibre releasing area 13'. In the shown example, both effective areas A and A' are arranged one behind the other in relation to the longitudinal direction of the body of the fibre channel insert. The fibre channel insert 2 is hereby also insertable rotated at an angle of 180° in the mounting opening 12 of the opening roller housing 3. By these means it is possible to provide two different sectional areas 9*b*, 13, 14 of a fibre channel 9 in a single fibre channel insert 2, which are applicable without changing the adapter.

Figure 6:
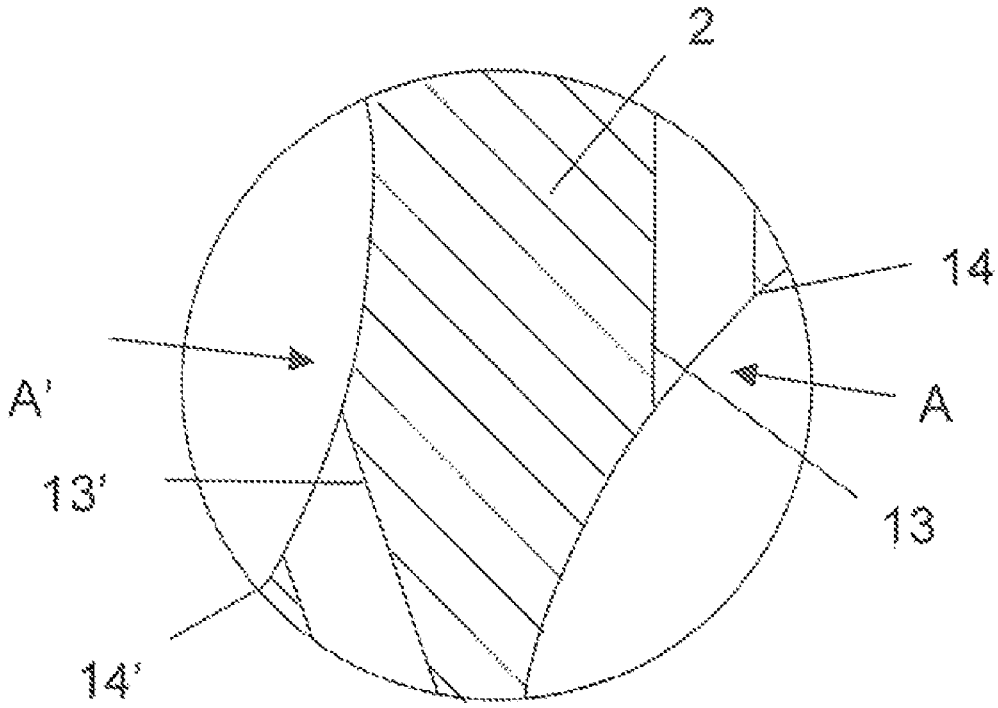
FIG. 6 shows a schematic view of a fibre channel insert comprising to radially staggered effective areas.

FIG. 6 shows a schematic section view of a fibre channel insert 2, in which two effective areas A and A' are provided one behind the other in relation to the circumferential direction of the fibre channel insert 2. By these means and in the case of this embodiment, as in the above described example in FIG. 5, an unproblematic change between two different applications is possible without changing the fibre channel insert 2.

With the application of the fibre channel insert 2 of the present invention, aside from the facilitated assembly and disassembly and the improvements in relation to the fibre flow, a much higher level of flexibility in relation to the applications is also possible. As a result, various fibre entry areas can be provided in which the radius or the position of the fibre releasing edge 14 is changed, or the fibre releasing edge 13 is adapted in its design to the fibre material FM to be spun, to the spinning conditions and to the throughput volume of fibre material. Various fibre channel cross sections having defined reductions or expansions in the first section 9*b* can also be realized.

The present invention is not limited to the shown embodiments. A fibre channel insert 2 that only comprises the fibre releasing area 13 is also possible, while the fibre releasing edge 14 is arranged in the opening roller housing 3 or in a fibre channel component 7, also designed as an insert. Due to the simplicity of exchange, it is however advantageous to assign the fibre releasing edge 14, which as a rule is subject to wear, to the easily exchangeable fibre channel insert 2. Further variations are possible.

It should be appreciated by those skilled in the art that modifications and variations can be made to the embodiments of the invention described or illustrated herein without departing from the scope and spirit of the invention as set forth in the appended claims and their equivalents.

The invention claimed is:

1. A fiber channel insert configured for mounting into a mounting opening of an opening roller housing of an open-end spinning arrangement, comprising:

a fiber channel body having a longitudinally extending major axis, said fiber channel body further comprising a fiber channel section defined therein that forms a component of a fiber channel in the opening roller housing in which said fiber channel insert is inserted; and said fiber channel body configured such that said major axis of said fiber channel body is oriented transversely to a longitudinally extending major axis of the fiber channel in the opening roller housing.

2. The fiber channel insert as in claim 1, wherein said fiber channel body further comprises a supporting surface oriented substantially parallel to the major axis of the fiber channel in the opening roller housing, said supporting surface configured to mate with a complimentary surface in the opening roller housing to fix the axial position of said fiber channel body in the opening roller housing.

3. The fiber channel insert as in claim 2, further comprising at least one of positioning device configured with said supporting surface that engages with a complimentary positioning protrusion or recess define in the opening roller housing.

4. The fiber channel insert as in claim 1, wherein said fiber channel body comprises one of a cylindrical or conical member.

5. The fiber channel insert as in claim 1, wherein said fiber channel body comprises a cylindrical section with a groove defined therein for a sealing element.

6. The fiber channel insert as in claim 1, wherein said fiber channel body comprises a fiber releasing area of the fiber channel.

7. The fiber channel insert of claim 6, wherein said fiber releasing area is delimited by a fiber releasing edge.

8. The fiber channel insert as in claim 1, wherein said fiber channel body is releasably insertable into the opening roller housing for exchange of said fiber channel insert.

9. The fiber channel insert as in claim 1, comprising a first fiber releasing area defined in a first effective area and a second fiber releasing area defined in a second effective area.

10. The fiber channel insert as in claim 9, wherein said first and second effective areas are radially staggered on said fiber channel body, said fiber channel insert insertable into the opening roller housing in two radially staggered positions to individually align said first and second fiber releasing areas with the fiber channel.

11. The fiber channel insert as in claim 1, wherein said fiber channel body comprises a hand-grip area, wherein said fiber channel insert is manually insertable and removable from the opening roller housing.

12. An open-end spinning arrangement, comprising:

a spinning element;

an opener roller configured within an opening roller housing;

a fiber channel disposed so as to deliver fibers from said opening roller to said spinning element;

a fiber channel insert mounted into a mounting opening of said opening roller housing, said fiber channel insert further comprising:

a fiber channel body having a longitudinally extending major axis, said fiber channel body further comprising a fiber channel section defined therein that forms a component of said fiber channel; and said fiber channel body mounted within said opening roller housing such that said major axis of said fiber channel body is oriented transversely to a longitudinally extending major axis of said fiber channel.

13. The open-end spinning arrangement of claim 12, wherein said opening roller housing comprises a supporting surface disposed substantially parallel to said major axis of said fiber channel, said fiber channel body comprising a complimentary supporting surface that engages with said supporting surface of said opening roller housing to fix the axial position of said fiber channel body within said opening roller housing.

* * * * *